US008095029B2

(12) United States Patent
Sugiura

(10) Patent No.: US 8,095,029 B2
(45) Date of Patent: Jan. 10, 2012

(54) CONTROLLING FIXING DEVICE TEMPERATURE OF AN IMAGE FORMING APPARATUS BASED ON TARGET TEMPERATURE

(75) Inventor: Takashi Sugiura, Kashiwa (JP)

(73) Assignee: Canon Kabushiki Kaisha (JP)

( * ) Notice: Subject to any disclaimer, the term of this patent is extended or adjusted under 35 U.S.C. 154(b) by 456 days.

(21) Appl. No.: 12/183,815

(22) Filed: Jul. 31, 2008

(65) Prior Publication Data

US 2009/0035004 A1 Feb. 5, 2009

(30) Foreign Application Priority Data

Aug. 2, 2007 (JP) ..... 2007-201949

(51) Int. Cl.
*G03G 15/20* (2006.01)

(52) U.S. Cl. ..... 399/69

(58) Field of Classification Search ..... 399/69, 399/67, 68, 336, 328
See application file for complete search history.

(56) References Cited

U.S. PATENT DOCUMENTS

2004/0086295 A1* 5/2004 Peng et al. ..... 399/69
2006/0210294 A1* 9/2006 Sone et al. ..... 399/69

FOREIGN PATENT DOCUMENTS

JP 62111274 A * 5/1987
JP 08278721 A * 10/1996
JP 2003-149981 A 5/2003
JP 2007286373 A * 11/2007

* cited by examiner

*Primary Examiner* — Quana M Grainger
(74) *Attorney, Agent, or Firm* — Rossi, Kimms & McDowell LLP

(57) ABSTRACT

An image forming apparatus which is capable of accurately detecting the temperature of a fixing roller by a simple circuit configuration without causing a scratch on the surface of the fixing roller. A detection sensor is disposed in a state not in contact with a heating-type fixing roller, for detecting the temperature of the fixing roller. A compensation sensor is provided for detecting an ambient temperature of the detection sensor. A computing section of a copy controller calculates the surface temperature of the fixing roller, using computing equations, based on information from the sensors. The copy controller controls the temperature of the fixing roller such that the surface temperature of the fixing roller, calculated by the computing section, becomes equal to a target temperature. The computing section uses different computing equations depending on the target temperature.

4 Claims, 15 Drawing Sheets

CONTROLLING FIXING DEVICE TEMPERATURE OF AN IMAGE FORMING APPARATUS BASED ON TARGET TEMPERATURE

BACKGROUND OF THE INVENTION

1. Field of the Invention

The present invention relates to an image forming apparatus, such as a copying machine, a printer or a facsimile machine, and a method of controlling the image forming apparatus.

2. Description of the Related Art

Conventionally, in an image forming apparatus using electrophotography, a fixing device has been widely used which incorporates a fixing heat roller that causes a sheet having a toner image transferred thereon to pass therethrough for heating and pressing the sheet, to thereby fix the unfixed toner image onto the sheet.

FIG. 10 shows a control circuit for the conventional fixing device. In the control circuit, there are arranged a halogen heater 21, a thermistor 22, A/D converters 23 and 24, a control section 25, an energization pattern-generating section 26, a heater drive circuit 27, and so forth.

The halogen heater 21 generates heat by being supplied with electric power. Energization of the heater is controlled such that the resistance value of the thermistor 22, which is disposed as a temperature-detecting element in a state in contact with the surface of a fixing roller, not shown, becomes constant with respect to a reference value.

The A/D converter 23 converts a voltage VT obtained according to a voltage-dividing ratio between the resistance value of a resistance RY of the thermistor 22 and the resistance value of a resistance R1 into a digital value thereof. The A/D converter 24 converts a control target voltage Vref1 into a digital value thereof. The A/D converters 23 and 24 output digital values SG1 and SG2 to the control section 25, respectively.

The energization pattern-generating section 26 delivers a heater control signal SG3 to the heater drive circuit 27 based on a signal SG4 from the control section 25.

In response to an input signal from a sensor 28, the control section 25 controls the temperature of the fixing roller by controlling the heating of the halogen heater 21 based on the digital value SG1 of the voltage VT applied to the thermistor 22, using the signal SG2 as a digital value of the control target voltage Vref1 optimum for fixing a toner image.

FIG. 11 shows an electrophotographic image forming apparatus.

This image forming apparatus is comprised of a photosensitive drum 1101 as an electrostatic latent image bearing member, a semiconductor laser 1102 as a light source, and a rotating polygon mirror 1103. A laser beam 1104 generated by the semiconductor laser 1102 scans the surface of the photosensitive drum 1101 via the rotating polygon mirror 1103 to thereby form an electrostatic latent image on the photosensitive drum 1101.

It should be noted that before the electrostatic latent image is formed on the photosensitive drum 1101, the surface of the photosensitive drum 1101 is uniformly charged by an electrostatic charging roller 1105. The electrostatic latent image formed on the photosensitive drum 1101 is developed into a toner image by a developing device 1106. The toner image is transferred on a sheet conveyed thereto, by a transfer roller 1107.

On the other hand, sheets are accommodated in a sheet feed cassette 1108 in a stacked state, and are fed from the sheet feed cassette 1108 into a conveying path by a sheet feed roller 1109.

Each sheet fed into the conveying path has a leading end thereof brought into abutment with a registration roller pair 1110 to have skew thereof corrected. Writing of image data on the photosensitive drum 1101 is performed in synchronism with sheet conveyance timing. The sheet is conveyed to a transfer position where a toner image formed on the photosensitive drum 1101 is transferred onto the sheet via the transfer roller 1107.

Disposed on the upstream side of the registration roller pair 1110 is a registration sensor 311 for detecting whether or not a sheet exits.

When the sheet having the toner image transferred thereon passes through a fixing roller 1112 along the conveying path, the sheet is heated and pressed to have the unfixed toner image fixed thereon. Then, the sheet having passed through the fixing roller 1112 is discharged from the apparatus by a discharge roller pair 1113, and the discharged sheet is detected by a sheet discharge sensor 1114.

FIG. 12 shows a control system of the image forming apparatus shown in FIG. 11.

Referring to FIG. 12, a printer controller 1201 converts image code data sent from a host computer into printable bitmap data. Further, the printer controller 1201 designates a print mode for the image forming apparatus and instructs the start of printing.

An engine controller 1202 controls mechanical units of the image forming apparatus based on instructions from the printer controller 1201.

A sheet conveyance controller 1203 performs operations e.g. for driving or stopping component parts of a conveyance system based on instructions from the engine controller 1202. A high voltage controller 1204 outputs high voltages for electrostatic charging, development of an image, and transfer of the image to a sheet, based on instructions of the engine controller 1202.

An optical system controller 1205 performs operations e.g. for driving or stopping a scanner motor, not shown, and flickering of the laser based on instructions from the engine controller 1202. A sensor input section 1206 receives information input from sensors, such as the registration sensor 311 and the sheet discharge sensor 1114, and sends the same to the engine controller 1202. A fixing device temperature controller 1207 controls the temperature of the fixing roller based on instructions from the engine controller 1202.

Next, the temperature control of the fixing roller will be described with reference to FIGS. 13A and 13B.

First, when the power is turned on, the engine controller 1202 initializes the image forming apparatus (step S1301), and then starts temperature control for holding the fixing roller at a standby temperature for a non-printing condition (step S1302).

This temperature control is executed by the CPU taking in a voltage value detected by a thermo-electric element (e.g. thermistor) attached in contact with the fixing roller, via an A/D converter, not shown, in the engine controller 1202.

The above A/D converted value and an A/D converted value corresponding to the standby temperature are compared with each other (step S1303).

Then, when the temperature of the fixing roller is higher than the standby temperature, a fixing heater is turned off (step S1304), whereas when the temperature of the fixing roller is lower than the standby temperature, the fixing heater is turned on (step S1305). This ON/OFF operation is carried out until a print request is received from the printer controller 1201.

When the print request is received, there is executed a process for starting the scanner motor, conveyance motors, not shown, of the conveyance system, drive sections for driving high voltage sections, and so forth, and causing the temperature of the fixing roller to rise to a printing temperature (steps S1307 to S1310).

After that, until the printing operation is terminated (step S1314), the ON/OFF operation of the fixing heater is continued in which when the temperature of the fixing roller is higher than the printing temperature, the fixing heater is turned off (step S1312), whereas when the temperature of the fixing roller is lower than the printing temperature, the fixing heater is turned on (step S1313).

It should be noted that the standby temperature of the fixing roller is set to be lower than the printing temperature, and the difference therebetween is fixed to a difference which is small enough for causing the temperature of the fixing roller to rise to the printing temperature before a sheet reaches the fixing roller after receipt of the print request.

However, in the above-described conventional temperature control of the fixing roller, the surface temperature of the fixing roller is detected by the thermistor or the like in contact with the fixing roller, and hence the contact sometimes causes a scratch on the surface of the fixing roller. In such a case, the scratch is transferred onto an image formed on a sheet passing the fixing roller, which produces a defective image.

To solve this problem, there has been proposed a technique that uses a non-contact detection sensor disposed in the vicinity of the surface of the fixing roller in a manner spaced therefrom and a compensation sensor for detecting the ambient temperature of the detection sensor, and estimates the surface temperature of the fixing roller using a computing equation based on information from the sensors (see e.g. Japanese Patent Laid-Open Publication No. 2003-149981).

More specifically, the computing equation is given by the surface temperature (° C.) of the fixing roller=(a×compensation voltage−b)×detected voltage+(c×compensation voltage+d). In this equation, the compensation voltage and the detected voltage are digital values which are obtained by A/D conversion of voltages detected by the compensation sensor and the detection sensor, respectively. Further, a, b, c and d represent coefficients, values of which are different depending on the compensation temperature.

In storing the computing equation, a conversion table is divided into a plurality of sections according to respective ranges of compensation temperature such that coefficients of the computing equation are determined on a section-by-section basis. The computing equation is stored together with each section of the table in an associated one of predetermined storage areas. This means that there are a plurality of computing equations having coefficients with different values. A computing equation to be used is determined depending on a compensation temperature detected by the compensation sensor, and the surface temperature of the fixing roller is calculated using the determined computing equation.

In the above-described proposal, it is assumed that by using the computing equations thus determined, the calculation of powers of values of the compensation temperature and the detection temperature can be eliminated to improve calculation speed.

However, according to the above-described Japanese Patent Laid-Open Publication No. 2003-149981, it is necessary to divide the conversion table into a plurality of sections according to ranges of the compensation temperature, and store coefficients determined on a section-by-section basis in each of the sections, to thereby store a plurality of computing equations. This requires complicated circuit configuration and control operations.

SUMMARY OF THE INVENTION

The present invention provides an image forming apparatus which is capable of accurately detecting the temperature of a fixing roller by a simple circuit configuration without causing a scratch on the surface of the fixing roller, and a method of controlling the image forming apparatus.

In a first aspect of the present invention, there is provided an image forming apparatus comprising a heating-type fixing roller, a detection sensor disposed in a state not in contact with the fixing roller, for detecting a temperature of the fixing roller, a compensation sensor for detecting an ambient temperature of the detection sensor, a computation unit configured to calculate a surface temperature of the fixing roller, using a computing equation, based on information from the detection sensor and the compensation sensor, and a control unit configured to control a temperature of the fixing roller such that the surface temperature of the fixing roller, calculated by the computation unit, becomes equal to a target temperature, wherein the computation unit uses different computing equations depending on the target temperature.

With the configuration of the first aspect of the present invention, it is possible to accurately detect the temperature of a fixing roller by a simple circuit configuration without causing a scratch on the surface of the fixing roller.

In a second aspect of the present invention, there is provided a method of controlling an image forming apparatus which includes a heating-type fixing roller, a detection sensor disposed in a state not in contact with the fixing roller, for detecting a temperature of the fixing roller, and a compensation sensor for detecting an ambient temperature of the detection sensor, comprising a computation step of calculating a surface temperature of the fixing roller, using a computing equation, based on information from the detection sensor and the compensation sensor, and a control step of controlling a temperature of the fixing roller such that the surface temperature of the fixing roller, calculated in the computation step, becomes equal to a target temperature, wherein the computation step includes using different computing equations depending on the target temperature.

The features and advantages of the invention will become more apparent from the following detailed description taken in conjunction with the accompanying drawings.

DETAILED DESCRIPTION OF THE EMBODIMENTS

The present invention will now be described in detail below with reference to the accompanying drawings showing embodiments thereof.

Figure 1:
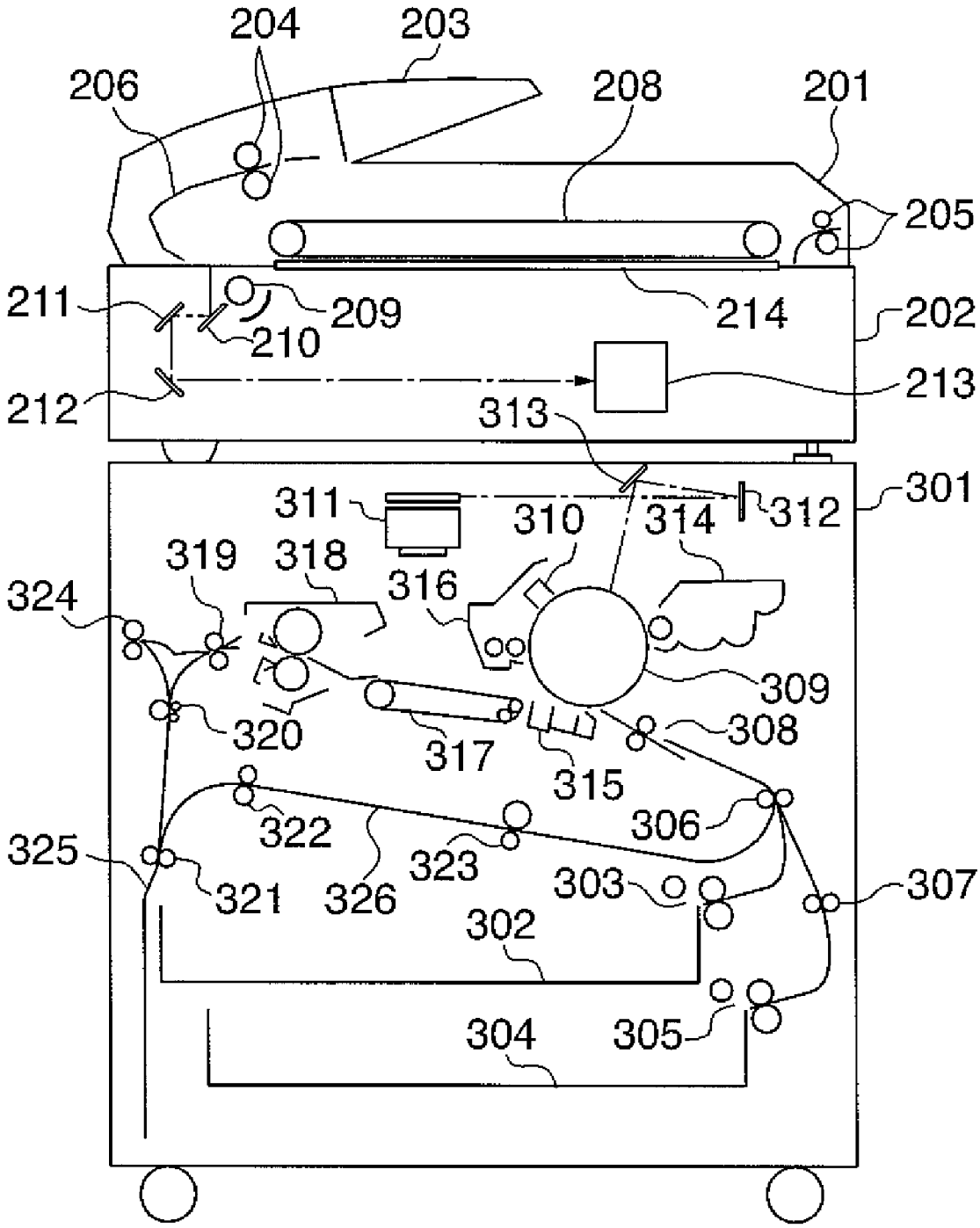
FIG. 1 is a schematic cross-sectional view of an image forming apparatus according to an embodiment of the present invention.

FIG. 1 is a schematic cross-sectional view of an image forming apparatus according to an embodiment of the present invention.

In the image forming apparatus according to the present embodiment, originals stacked on an original stacker 203 of an automatic document feeder unit 201 are separately fed by a feed roller pair 204, and each original is conveyed to a reading device 202 via a conveying guide 206. The original conveyed to the reading device 202 is further conveyed by a conveying belt 208 at a fixed speed, and is discharged from the apparatus by a discharge roller pair 205.

In the meantime, an image on the original illuminated by an illumination system 209 at a reading position of the reading device 202 is received via an optical system comprised of reflective mirrors 210, 211 and 212 by an image reading section 213 where the image is converted into an image signal. The image reading section 213 includes lenses, a CCD as a photoelectric conversion element, a drive circuit for driving the CCD, and so forth, none of which are shown.

Originals are read by the reading device 202 either in a moving original reading mode in which the original is conveyed at a fixed speed, and is read with the illumination system 209 and the optical system held stationary, or in a fixed original reading mode in which the original is placed on an original platen glass 214 and is read by moving the illumination system 209 and the optical system at a fixed speed. Usually, sheet originals are read in the moving original reading mode, and bound originals are read in the fixed original reading mode.

The image signal obtained by conversion by the image reading section 213 is processed by an image processing section 102 (see FIGS. 2 and 3), and is then copied onto sheets on a page-by-page basis by an image forming section 301. That is, the image signal is modulated into an optical signal e.g. by a semiconductor laser, not shown.

The laser beam modulated based on the image signal is irradiated onto a photosensitive drum 309 having a surface thereof uniformly charged by a primary electrostatic charger 310, via an optical scanner 311, such as a polygon mirror, and mirrors 312 and 313, whereby an electrostatic latent image is formed on the photosensitive drum 309. The electrostatic latent image is developed as a toner image by a toner supplied from a developing device 314, and the toner image is transferred on a sheet by a transfer charger 315.

Sheets are contained in sheet feed cassettes 302 and 304. It should be noted that in the present embodiment, the sheet feed cassette 302 contains standard sheets, and the sheet feed cassette 304 contains tab sheets.

The standard sheets contained in the sheet feed cassette 302 are each fed into a conveying path by a feed roller pair 303. Each standard sheet fed to the conveying path is conveyed to a registration roller pair 308 by a conveying roller pair 306, and is conveyed to a transfer position of the photosensitive drum 309 after image forming operation and conveying timing are adjusted by the registration roller pair 308.

On the other hand, the tab sheets contained in the sheet feed cassette 304 are each fed to the conveying path by a feed roller pair 305. Each tab sheet fed to the conveying path is conveyed to the registration roller pair 308 by a conveying roller pair 307 and the conveying roller pair 306, and is conveyed to the transfer position of the photosensitive drum 309 after the registration roller pair 308 adjusts sheet conveying timing with respect to image formation.

The sheet having the toner image transferred thereon is conveyed to a fixing device 318 by a transfer belt 317, and is subjected to a heating and pressing process such that an unfixed toner image is fixed on the sheet.

It should be noted that when a single-sided mode is set, a sheet having passed through the fixing device 318 is discharged from the apparatus by a fixing/discharge roller pair 319 and a discharge roller pair 324.

Further, when a double-sided mode is set, a sheet having passed through the fixing device 318 is conveyed to an inverting path 325 by an inverting roller pair 321 via the fixing/discharge roller pair 319 and a conveying roller pair 320.

Rotation of the inverting roller pair 321 is reversed immediately after the trailing end of the sheet has passed a merging point where the inverting path 325 meets a double-sided path 326, whereby the sheet is inverted and conveyed into the double-sided path 326. The sheet conveyed into the double-sided path is conveyed by roller pairs 322 and 323, and is conveyed again to the registration roller pair 308 via the conveying roller pair 306 for being subjected to the same process as described above.

Further, to discharge the sheet having passed through the fixing device 318 from the apparatus, in an inverted state, the sheet is temporarily conveyed to the conveying rollers 320, and immediately before the trailing end of the sheet has passed through the conveying rollers 320, the rotation of the conveying rollers 320 is reversed, whereby the sheet is discharged from the apparatus by the discharge roller pair 324.

Next, a copy controller 105 of the image forming section 301 will be described with reference to FIG. 2.

Figure 2:
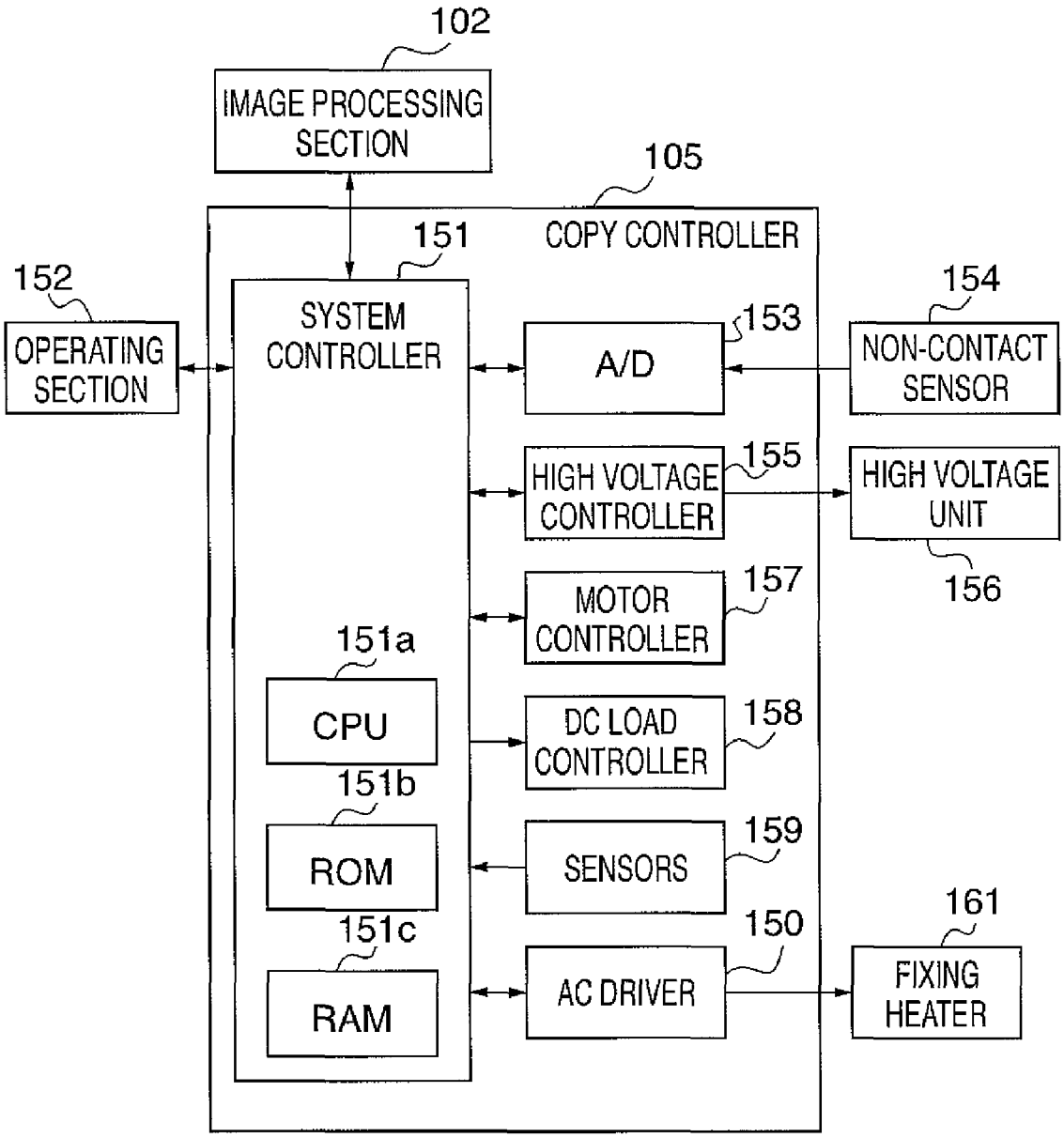
FIG. 2 is a block diagram useful in explaining a copy controller of an image forming section.

As shown in FIG. 2, the copy controller (control unit) 105 includes a system controller 151 which controls the overall operation of the image forming apparatus in a centralized fashion. The system controller 151 mainly drives loads in the apparatus, and collects and analyzes information from sensors and the like. Further, the system controller 151 exchanges data between the same and an operating section 152, i.e. a user interface.

The system controller 151 incorporates a CPU 151*a*, a ROM 151*b* and a RAM 151*c*. The CPU 151*a* executes various processes concerning image formation which are predetermined by a program stored in the ROM 151*b*. Further, in doing this, the CPU 151*a* stores rewritable data, which is required to be temporarily or permanently stored, in the RAM 151*c*. The RAM 151*c* stores high voltage-setting values for a high voltage controller 155, various kinds of data, image forming command information from the operating section 152, and so forth.

Further, the system controller 151 not only sends data of specification set values of sections and components of the image forming apparatus, required by the image processing section 102, but also receives signals, such as original image density signals, from sections and components of the same. Then, the system controller 151 controls the copy controller 105 and the image processing section 102, to thereby perform settings for forming optimum images.

Furthermore, the system controller 151 not only obtains from the operating section 152, information e.g. on values of copying magnification and density setting, set by the user, but also sends to the same, data for notifying the user of conditions of the image forming apparatus. Examples of the conditions of the image forming apparatus include the number of sheets on which an image is to be formed, information on whether or not the image is being formed, and occurrence of paper jam and a location where the paper jam has occurred. Further, the system controller 151 exchanges information with the operating section 152 so as to perform various settings for tab sheets, and display warning messages on a tab sheet.

Motors, not shown, DC loads, not shown, such as clutch solenoids, and sensors 159, such as photointerrupters and micro switches, are disposed at various locations of the image forming apparatus. That is, by driving the motors and the DC loads as required, conveyance of sheets and driving of units are performed, and the conveying and driving operations are monitoring by the sensors 159.

To this end, the system controller 151 controls the motors by a motor controller 157 based on signals from the sensors 159, and causes a DC load controller 158 to operate the clutch solenoids to smoothly carry out an image forming operation.

Further, the system controller 151 delivers high voltage control signals to the high voltage controller 155 to thereby apply appropriate high voltages to the primary electrostatic charger 310, the transfer charger 315, and the developing device 314, which are chargers forming a high voltage unit 156.

Furthermore, the fixing device 318 includes a fixing roller 1543 which incorporates a heater 161 for heating the fixing roller 1543. An AC driver 160 performs ON/OFF control of the heater 161. Further, a non-contact sensor 154 is provided in the vicinity of the surface thereof the fixing roller 1543, for detecting the surface temperature of the fixing roller 1543.

Information detected by the non-contact sensor 154 is converted by an A/D converter 503 into a voltage value dependent on a change in the temperature of the fixing roller 1543, and then is input to the system controller 151 as a digital value. The system controller 151 controls the AC driver 160 based on the input data.

Figure 3:
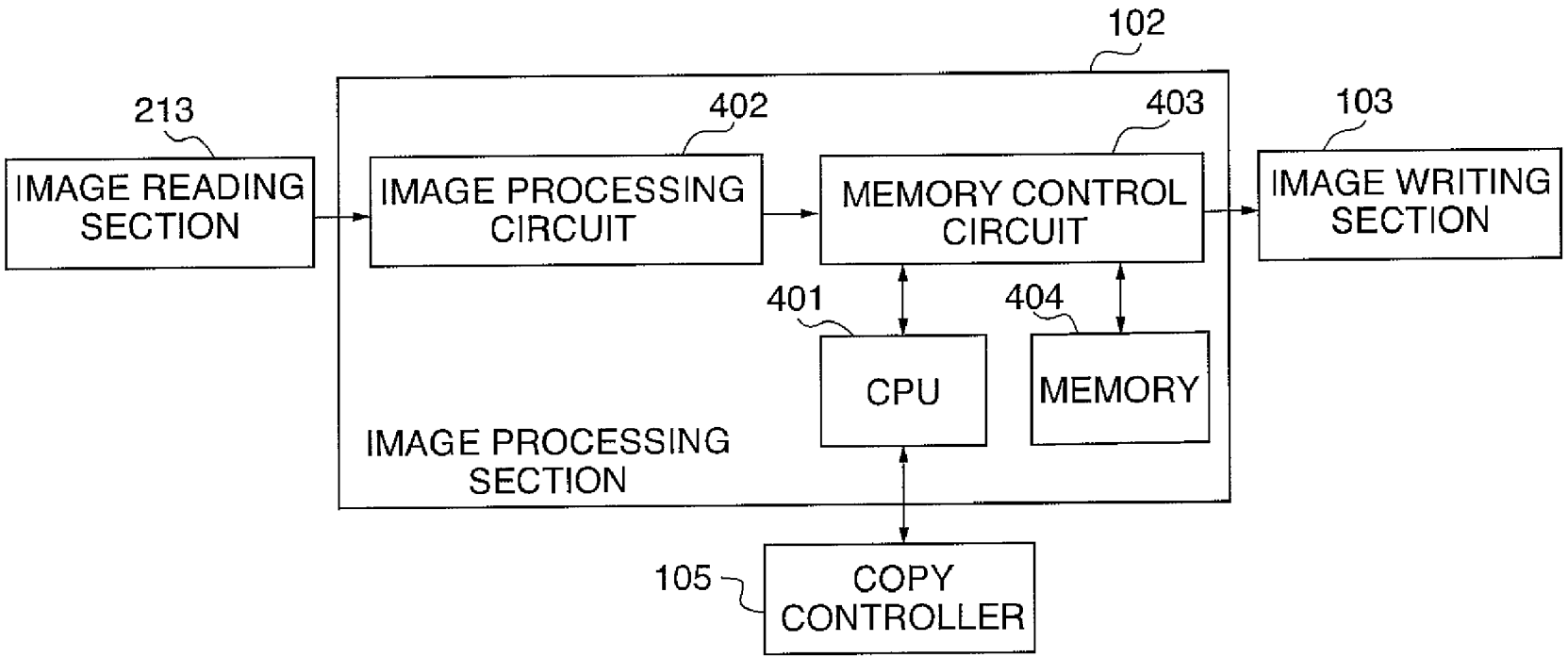
FIG. 3 is a block diagram useful in explaining an image processing section.

Next, the image processing section 102 will be described with reference to FIG. 3.

Image data of an original read by the image reading section 213 is input to the image processing section 102, and is subjected to predetermined image processing by an image processing circuit 402, whereafter the processed image data is input to a memory control circuit 403. Under the control of the CPU 401, the memory control circuit 403 stores the input image data in a memory 404, and reads out image data based on which an image is formed, from the memory 404, to output the image data to an image writing section 103.

The CPU 401 controls the memory control circuit 403 to thereby cause the input image data tp be stored in the memory 404, and cause the image data stored in the memory 404 to be output to the image writing section 103. Further, the CPU 401 controls the memory control circuit 403 to thereby cause the image data stored in the memory 404 to be read out to detect an image area within a page of the image data where exists image data based on which the image is actually formed, and notify the copy controller 105 of the image area.

Figure 4:
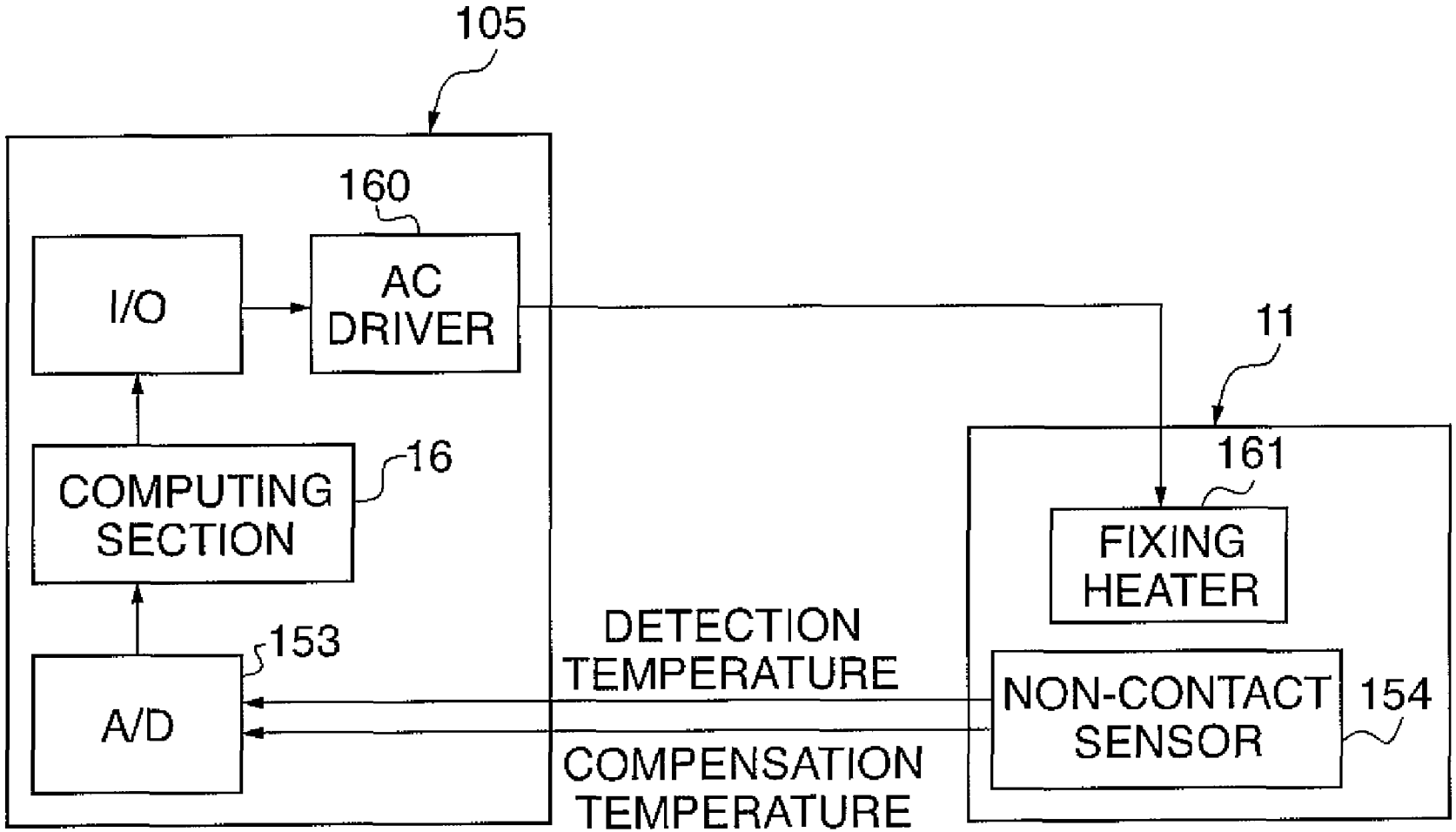
FIG. 4 is a block diagram useful in explaining a system configuration of a fixing unit and the copy controller of the image forming apparatus.

FIG. 4 is a diagram showing a system configuration of a fixing unit and the copy controller of the image forming apparatus. It should be noted that components corresponding to those in FIG. 2 are denoted by identical reference numerals.

Figure 14A:
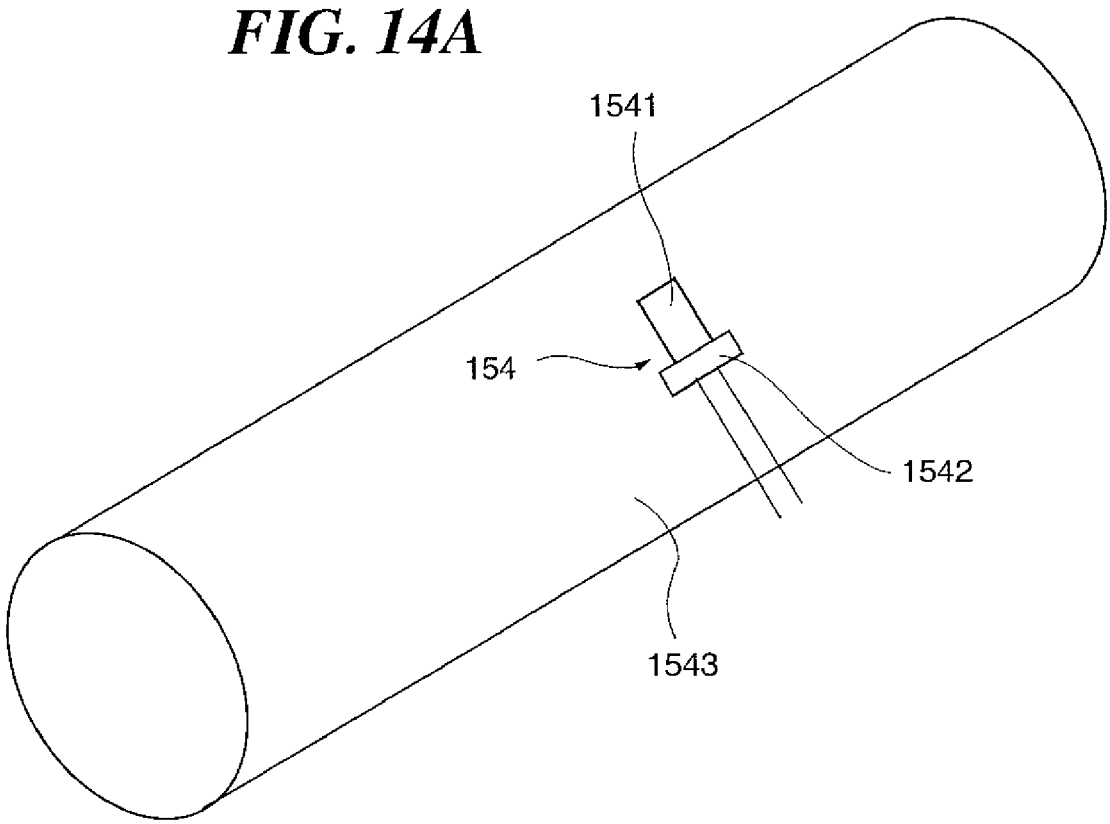
FIG. 14A is a perspective view of the fixing roller and a non-contact detection sensor used in the present embodiment, which is useful in explaining an example of disposition of the non-contact sensor with respect to the fixing roller.
Figure 14B:
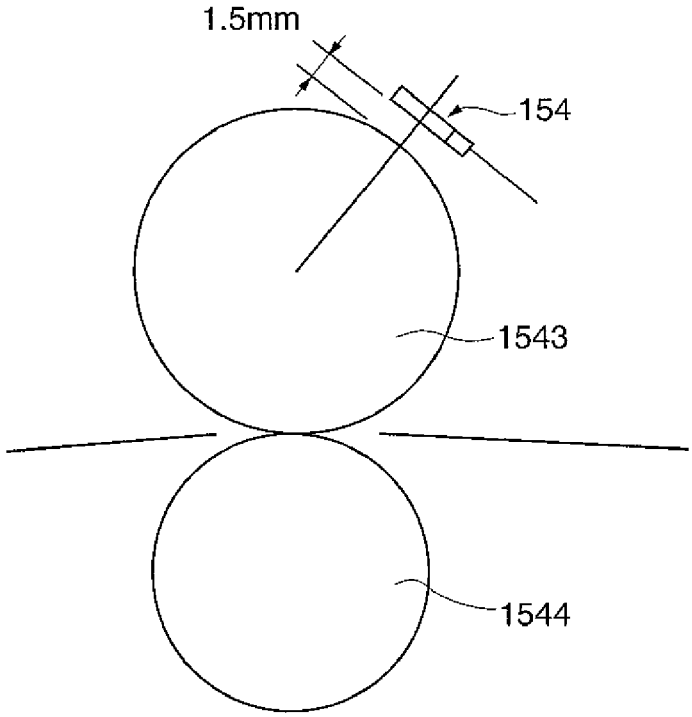
FIG. 14B is a cross-sectional view of the fixing roller and the non-contact sensor according to the present embodiment, which is useful in explaining the example of disposition of the non-contact sensor with respect to the fixing roller.

The fixing unit 11 is comprised of the non-contact sensor 154, the fixing heater 161, the fixing heat roller 1543, and a pressing roller 1544 (see FIGS. 14A and 14B).

As shown in FIGS. 14A and 14B, the non-contact sensor 154 includes a non-contact detection sensor 1541 and a compensation sensor 1542 for detecting the ambient temperature of the detection sensor 1541, which are arranged in the vicinity of the surface of the fixing roller 1543 in a manner spaced from the surface.

Voltages detected by the detection sensor 1541 and the compensation sensor 1542 are converted into digital values within a range of 0 to 1023 by an A/D converter 153 provided in the copy controller 105. The converted digital values are input to a computing section (computation unit) 16 of a CPU 151*a* of the system controller 151 as a detection temperature and a compensation temperature. The surface temperature of the fixing roller 1543 is calculated from the input digital values using a computing equation by the computing section 16.

Then, the AC driver 160 performs ON/OFF control of the fixing heater 161 based on the surface temperature of the fixing roller 1543 calculated by the computing section 16.

Figure 5:
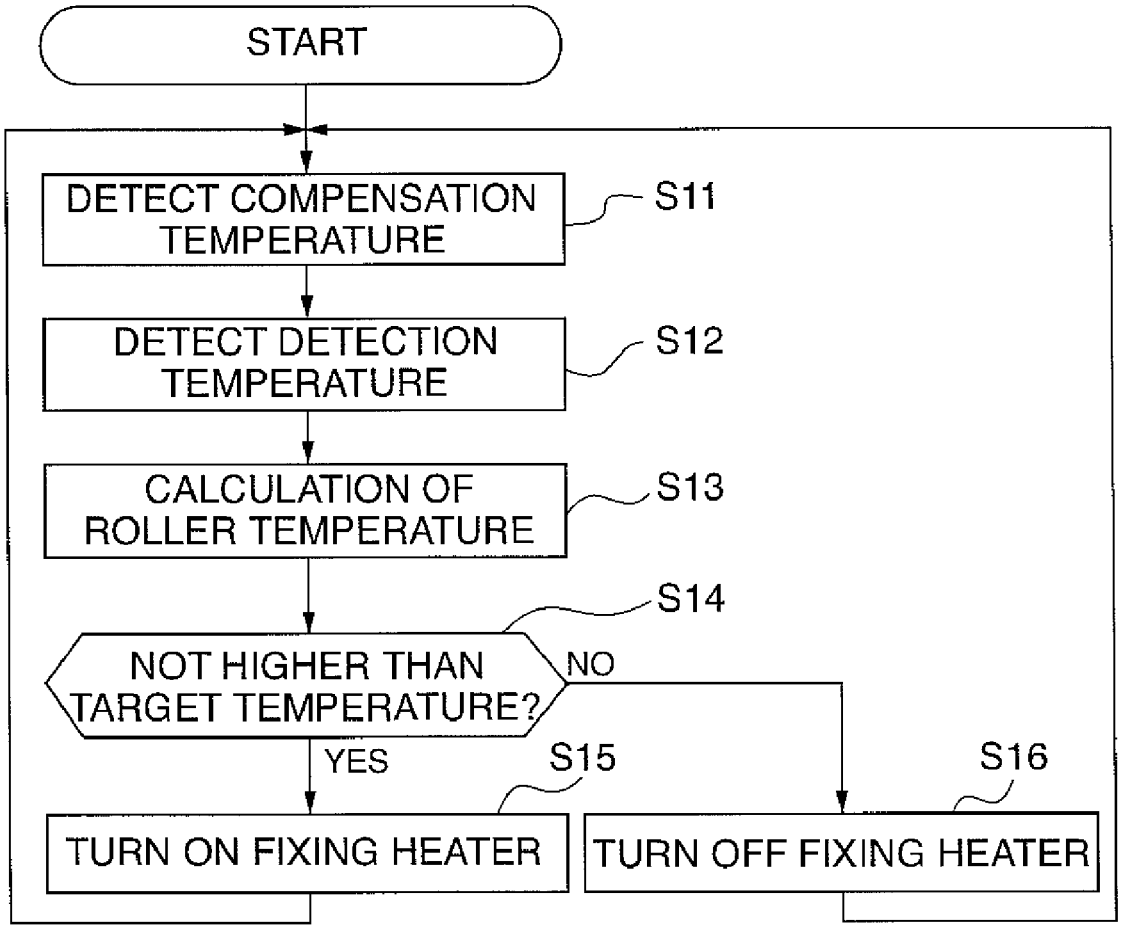
FIG. 5 is a flowchart of a surface temperature control process for controlling a surface temperature of a fixing roller, carried out by the copy controller.

FIG. 5 is a flowchart of a surface temperature control process for controlling the surface temperature of the fixing roller 1543, executed by the copy controller 105. It should be noted that the process shown in FIG. 5 is executed by the CPU 151*a* after a program stored e.g. in the ROM 151*b* of the system controller 151 is loaded into the RAM 151*c*.

First, voltages detected by the detection sensor 1541 and the compensation sensor 1542 of the non-contact sensor 154 are converted into digital values by the A/D converter 153 to detect a detection temperature and a compensation temperature (steps S11 and S12).

Next, the surface temperature of the fixing roller 1543 is calculated by the computing section 16 based on the detection temperature and the compensation temperature detected in the steps S11 and S12 (step S13). It should be noted that a method of calculating the surface temperature of the fixing roller 1543 by the computing section 16 will be described hereinafter.

Then, it is determined whether or not the temperature calculated in the step S13 is not higher than a target temperature (step S14). If the temperature is not higher than the target temperature, the system controller 151 causes the AC driver 160 to turn on the fixing heater 161 (step S15), followed by the process returning to the step S11.

On the other hand, if it is determined in the step S14 that the surface temperature of the fixing roller 1543 is higher than the target temperature, the system controller 151 causes the AC driver 160 to turn off the fixing heater 161 (step S13), followed by the process returning to the step S11.

Next, the method of calculating the surface temperature of the fixing roller 1543 in the step S13 in FIG. 5 will be described with reference to FIGS. 6 to 9.

Figure 6:
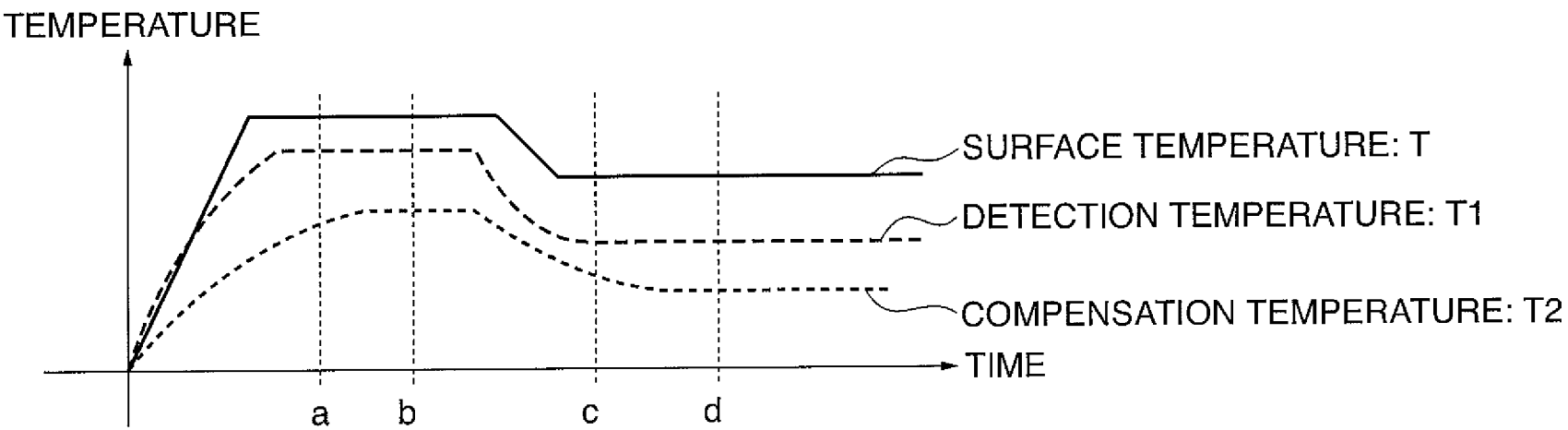
FIG. 6 is a view of a graph showing the relationship between a detection temperature T1 detected by a detection sensor, a compensation temperature T2 detected by a compensation sensor, a surface temperature T of the fixing roller, calculated based on the detection temperature T1 and the compensation temperature T2, and time periods.

FIG. 6 is a view of a graph showing the relationship between the detection temperature T1 detected by the detection sensor, the compensation temperature T2 detected by the compensation sensor, the surface temperature T of the fixing roller 1543, calculated based on the detection temperature T1 and the compensation temperature T2, and time.

As shown in FIG. 6, when the temperatures T, T1 and T2 are compared with each other at respective moments of a time point a and a time point b, the detection temperature T1 changes approximately in proportion to the surface temperature T but the compensation temperature T2 changes without proportional relation to the surface temperature T.

This is because time periods required for the detection temperature and the compensation temperature to reach respective predetermined target temperatures are different due to the difference between the heat capacity of the detection sensor and that of the compensation sensor. The same also applies to a case where the temperatures T, T1 and T2 are compared with each other at respective moments of a time point c and a time point d.

Further, the surface temperature T, the detection temperature T1, and the compensation temperature T2 assumed when they become stable are determined depending on the difference between the thermal resistance of the detection sensor and that of the compensation sensor. To calculate the surface temperature T from the detection temperature T1 and the compensation temperature T2, it is required to know the surface temperature T, the detection temperature T1, and the compensation temperature T2 which have become stable.

Figure 7:
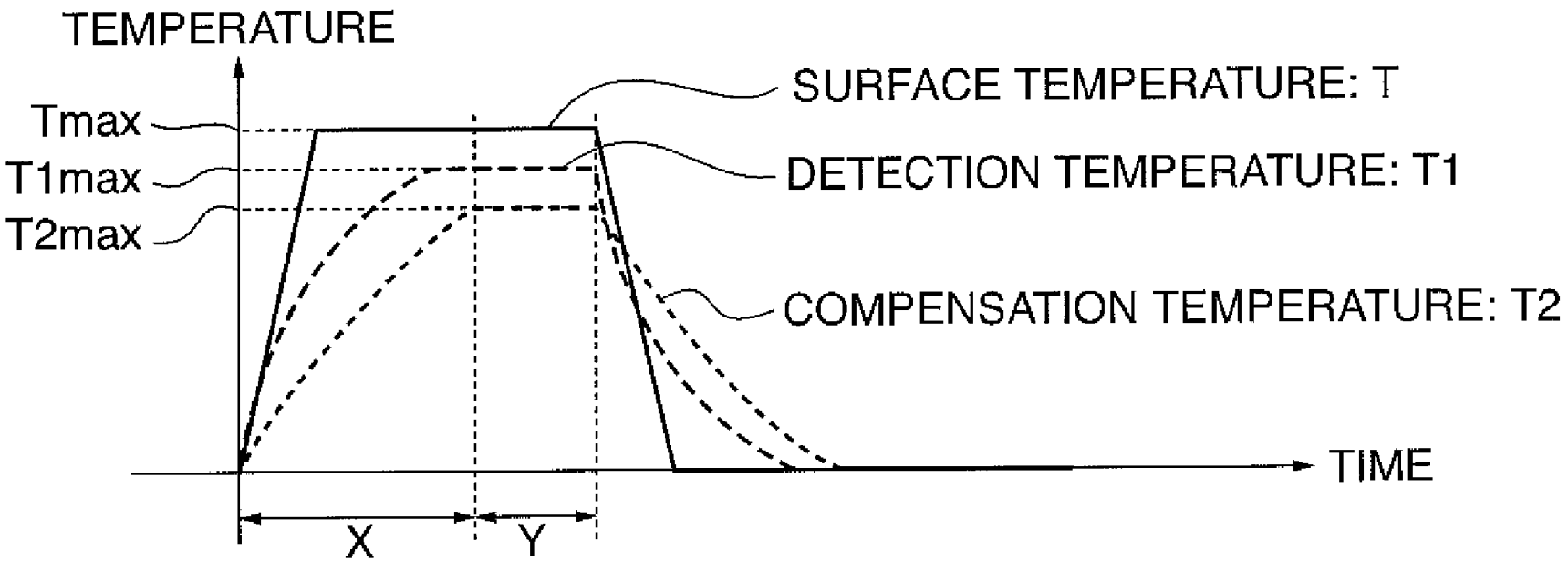
FIG. 7 is a view of a graph which is useful in explaining a method of calculating the surface temperature T of the fixing roller from the detection temperature T1 and the compensation temperature T2 when a temperature of the fixing roller rises.

FIG. 7 is a view of a graph which is useful in explaining a method of calculating the surface temperature T of the fixing roller 1543 from the detection temperature T1 and the compensation temperature T2 when the temperature of the fixing roller 1543 rises.

In FIG. 7, Tmax represents the target temperature of the surface temperature T, T1max represents the maximum value of the detection temperature T1, and T2max represents the maximum value of the compensation temperature T2. Further, X represents a region where the compensation temperature T2 has not reached T2max, and Y represents a region where the compensation temperature T2 has reached T2max.

First, in the region Y, the surface temperature T, the detection temperature T1, and the compensation temperature T2 have already been stabilized. In this state, the surface temperature T, the detection temperature T1, and the compensation temperature T2 are constant, and are in a proportional relationship.

Next, in the region X, although in the vicinity of the region Y, it can be said that the surface temperature T and the detection temperature T1 are stable and they are in a proportional relationship, the compensation temperature T2 is not stable. This is caused by the difference between the heat capacity of the detection sensor and that of the compensation sensor.

Therefore, to calculate the surface temperature T of the fixing roller 1543 from the detection temperature T1 and the compensation temperature T2, it is necessary to take the degree of influence of the compensation temperature T2 into account.

More specifically, it is necessary to correct the surface temperature T by adding a value proportional to an amount of the difference between the compensation temperature T2 and the maximum value T2max to the compensation temperature T2 until the compensation temperature T2 reaches the maximum value T2max. More specifically, when the temperature of the fixing roller 1543 rises, a computing equation for calculating the surface temperature T of the fixing roller 1543 from the detection temperature T1 and the compensation temperature T2 can be given by the following equation (1):

$$T=\alpha u\times T1+\beta u\times(T2\max-T2) \quad (1)$$

It should be noted that as shown in Table 1 and Table 2, optimum values of αu and βu are selected whenever the number of sheets having passed through the fixing roller 1543 has reached a predetermined value.

TABLE 1

| | | αu | | | | |
|---|---|---|---|---|---|---|
| | | 0~10000 | 10000~20000 | 20000~30000 | . . . | Numbers of sheets passed |
| T1 (° C.) | ~50 | 1 | 1.1 | 1.2 | . . . | |
| | 50~75 | 1.05 | 1.15 | 1.25 | . . . | |
| | 75~100 | 1.1 | 1.2 | 1.3 | . . . | |
| | 100~125 | 1.15 | 1.25 | 1.35 | . . . | |
| | 125~150 | 1.2 | 1.3 | 1.4 | . . . | |
| | 150~175 | 1.25 | 1.35 | 1.45 | . . . | |
| | 175~200 | 1.3 | 1.4 | 1.5 | . . . | |

TABLE 2

| | | βu | | | | |
|---|---|---|---|---|---|---|
| | | 0~10000 | 10000~20000 | 20000~30000 | ... | Numbers of sheets passed |
| T2max − T2 (° C.) | ~0.5 | 1 | 0.98 | 0.96 | ... | |
| | 0.5~1.0 | 0.95 | 0.93 | 0.91 | ... | |
| | 1.0~1.5 | 0.9 | 0.88 | 0.86 | ... | |
| | 1.5~2.0 | 0.85 | 0.83 | 0.81 | ... | |
| | 2.0~2.5 | 0.8 | 0.78 | 0.76 | ... | |

Figure 8:
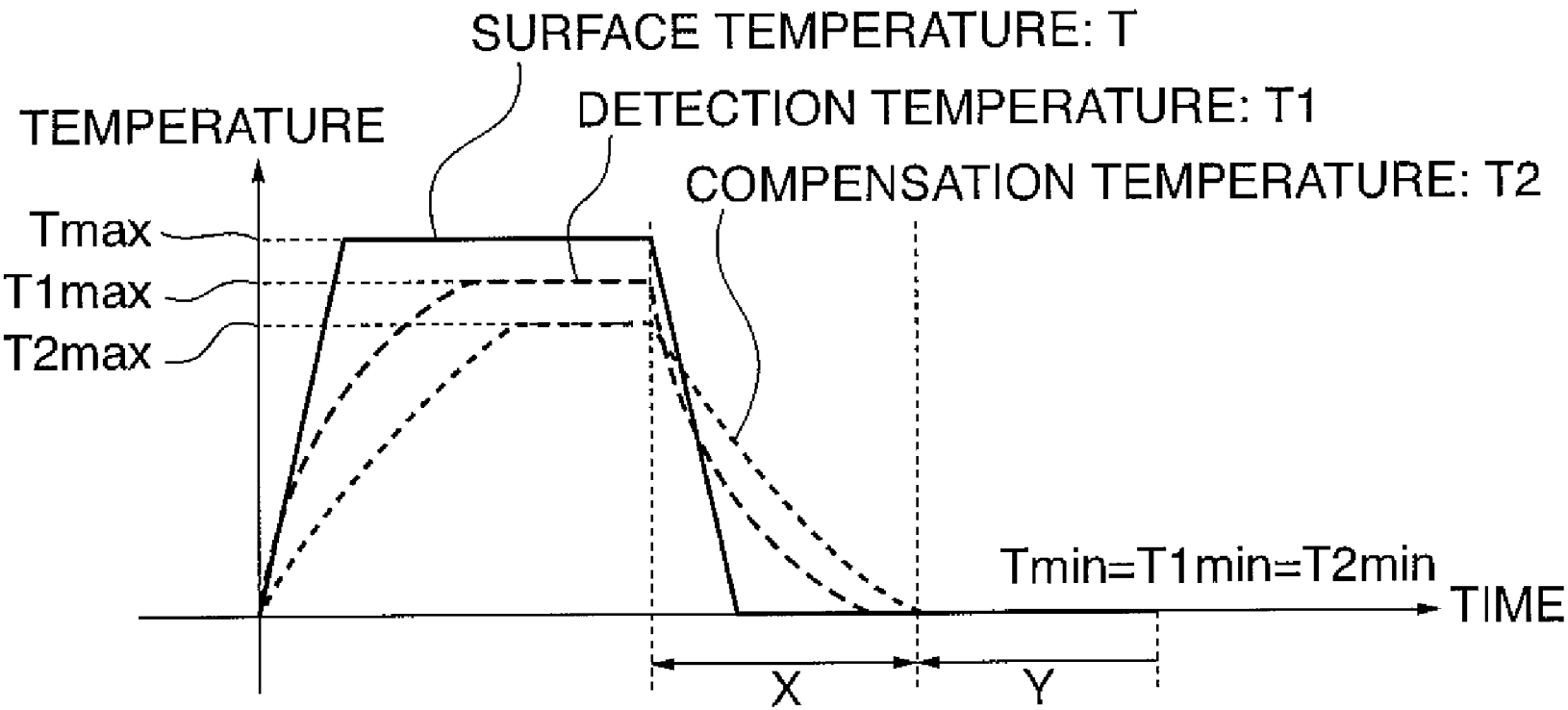
FIG. 8 is a view of a graph which is useful in explaining a method of calculating the surface temperature T of the fixing roller from the detection temperature T1 and the compensation temperature T2 when the temperature of the fixing roller drops.

FIG. 8 is a view of a graph which is useful in explaining a method of calculating the surface temperature T of the fixing roller 1543 from the detection temperature T1 and the compensation temperature T2 when the temperature of the fixing roller 1543 drops.

In FIG. 8, Tmin represents the target temperature of the surface temperature T, T1min represents the minimum value of the detection temperature T1, and T2min represents the minimum value of the compensation temperature T2.

Similarly to the case of rising of the temperatures, in the case of dropping of the temperatures, the temperatures Tmin, T1min and T2min b assumed when the fixing roller 1543 is in a cooled state, are equal to each other. That is, Tmin=T1min=T2min holds. However, the temperature from which the temperature control is started when the temperature of the fixing roller 1543 drops is different as indicated by Tmax, T1max and T2max, and a temperature change curve indicative of a drop of each temperature when the temperature of the fixing roller 1543 drops is different from that indicative of a rise of the same when the temperature of the fixing roller 1543 rises. Therefore, it is impossible to use the same computing equation when the temperature of the fixing roller 1543 rises and when it is drops.

Further, similarly to the case of a rise of the temperature, when a region where the compensation temperature T2 has not reached the minimum value T2min is represented by X, and a region where the compensation temperature T2 has reached the minimum value T2min is represented by Y, the surface temperature T, the detection temperature T1, and the compensation temperature T2 are stable, and are equal to each other, in the region Y.

However, in the region X, although in the vicinity of the region Y, it can be said that the surface temperature T and the detection temperature T1 have already reached the respective minimum values Tmin and T1min (Tmin=T1min) to become stable, the compensation temperature T2 is not stable.

Therefore, to calculate the surface temperature T of the fixing roller 1543 from the detection temperature T1 and the compensation temperature T2, it is necessary to take into account the degree of influence of the compensation temperature T2, and the fact that the temperature from which the temperature control is started is different as indicated by Tmin, T1min, and T2min when the temperature of the fixing roller 1543 drops.

As is apparent from the above, when the temperature of the fixing roller 1543 drops, a computing equation for calculating the surface temperature T of the fixing roller 1543 from the detection temperature T1 and the compensation temperature T2 can be given by the following equation (2):

$$T=T1\max\times\alpha d\times(T1\max-T1)-\beta d\times(T2\max-T2) \quad (2)$$

It should be noted that similarly to αu and βu, optimum values of αd and βd are selected whenever the number of sheets having passed through the fixing roller 1543 has reached a predetermined value.

Although the above-described equations (1) and (2) are extreme examples of the computing equations which are used when the surface temperature of the fixing roller 1543 is controlled to a predetermined target temperature T by heating the fixing roller 1543 and when the target temperature T is controlled to 0° C. by cooling the fixing roller 1543, respectively, it is understood from the equations that the computing equations are required to be switched when the temperature of the fixing roller 1543 rises and when it drops.

In the image forming apparatus, there also exists a model which operates with a plurality of controlled temperatures. In this case, when the temperature of the fixing roller 1543 rises or drops, it is possible to accurately control the temperature of the fixing roller 1543 by switching the computing equations for calculating the surface temperature of the fixing roller 1543 from the detection temperature and the compensation temperature.

Figure 9:
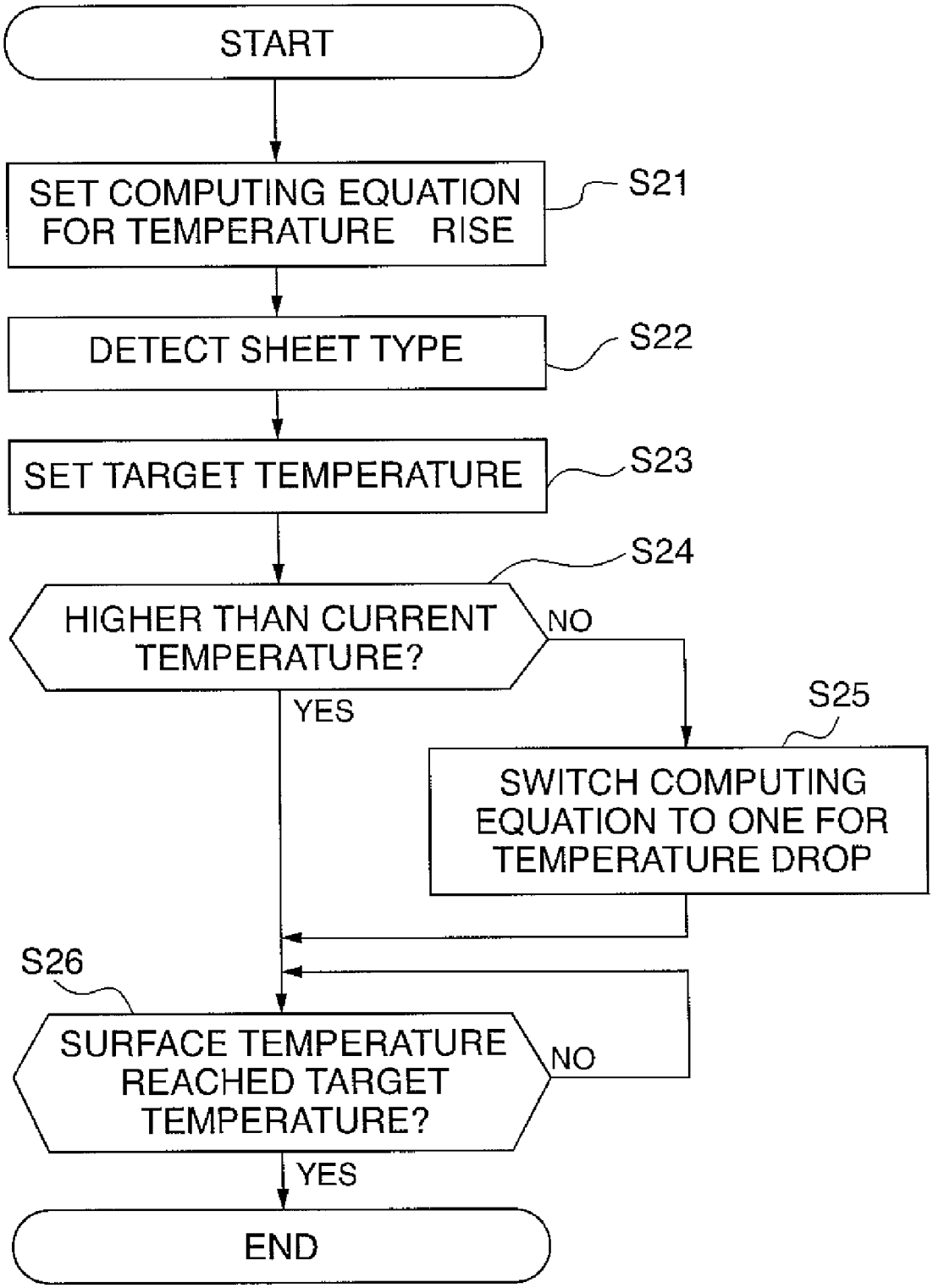
FIG. 9 is a flowchart which is useful in explaining an example of a process for switching computing equations for calculating the surface temperature of the fixing roller from the detection temperature and the compensation temperature, between when the temperature of the fixing roller rises and when it is drops.
Figure 10:
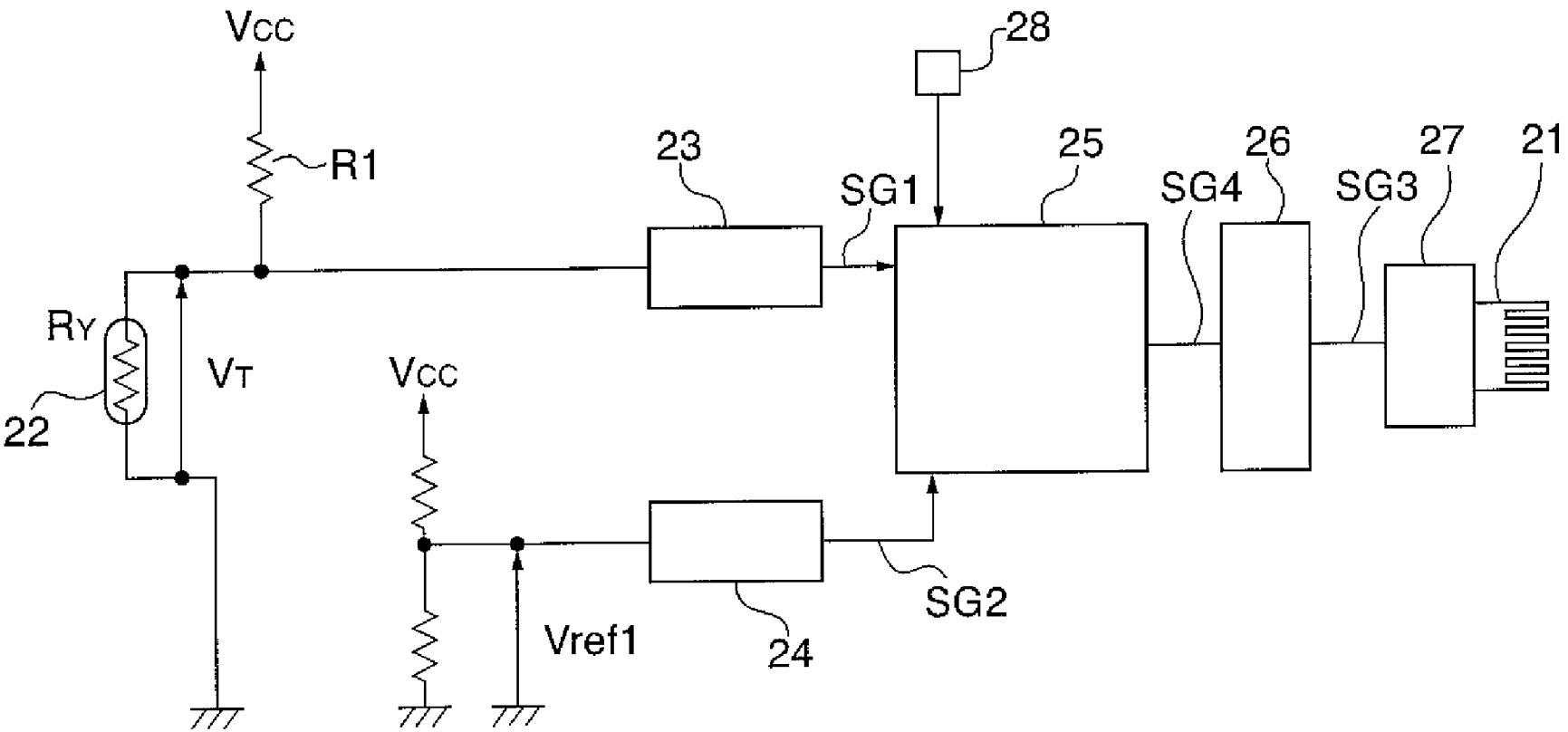
FIG. 10 is a block diagram useful in explaining a control circuit for a conventional fixing device.
Figure 11:
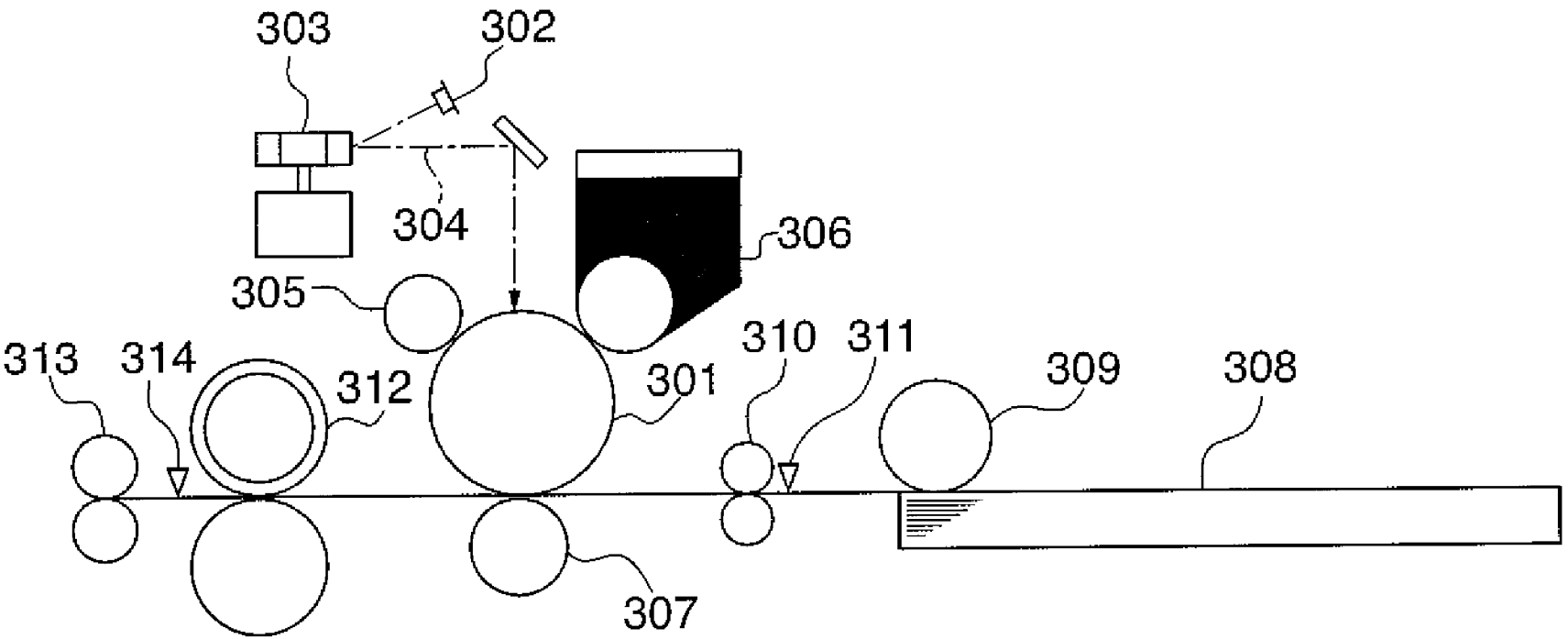
FIG. 11 is a schematic cross-sectional view useful in explaining a conventional electrophotographic image forming apparatus.
Figure 12:
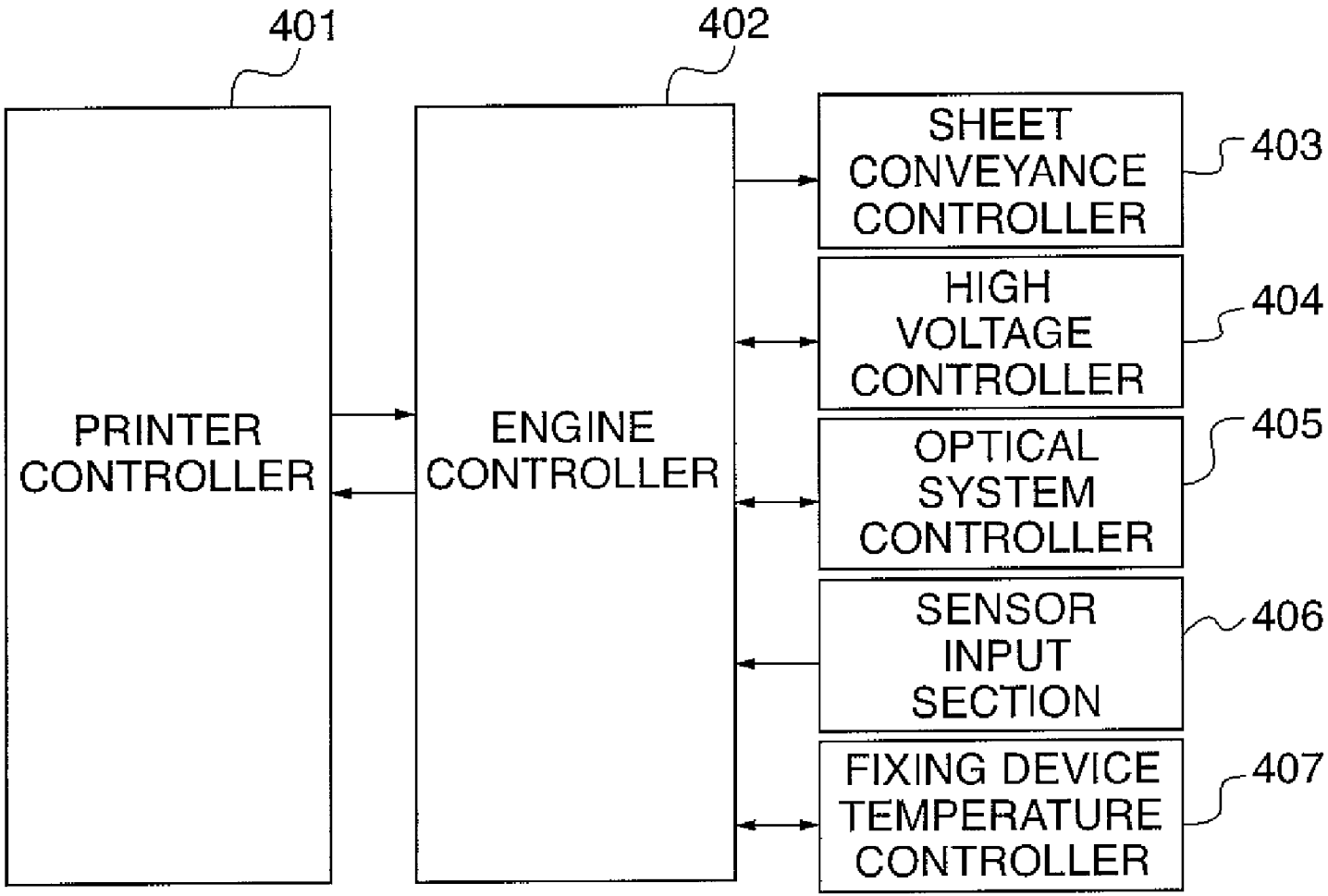
FIG. 12 is a block diagram useful in explaining a control system of the conventional image forming apparatus appearing in FIG. 11.
Figure 13A:
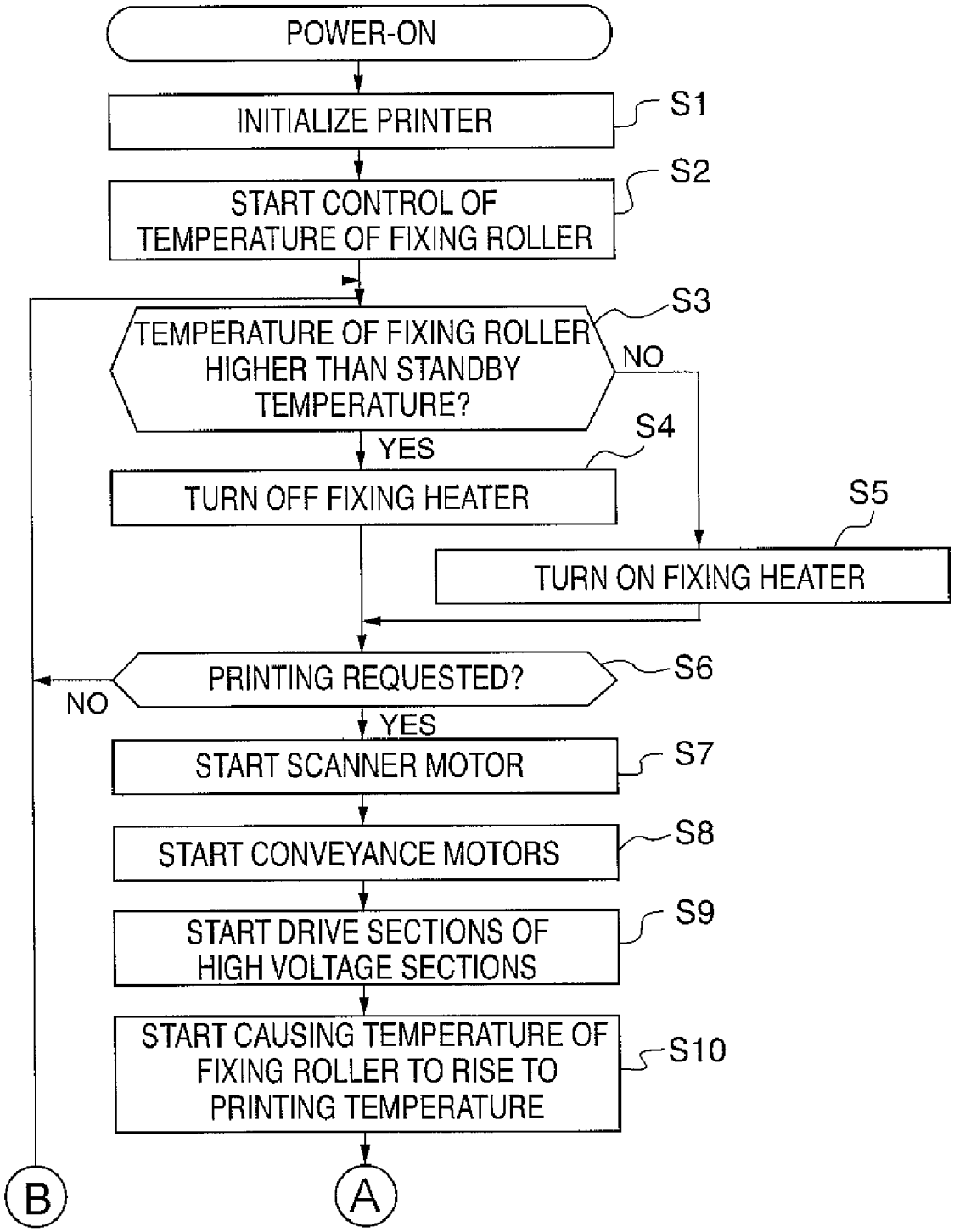
FIGS. 13A and 13B are a flowchart which is useful in explaining temperature control of a conventional fixing roller.
Figure 13B:
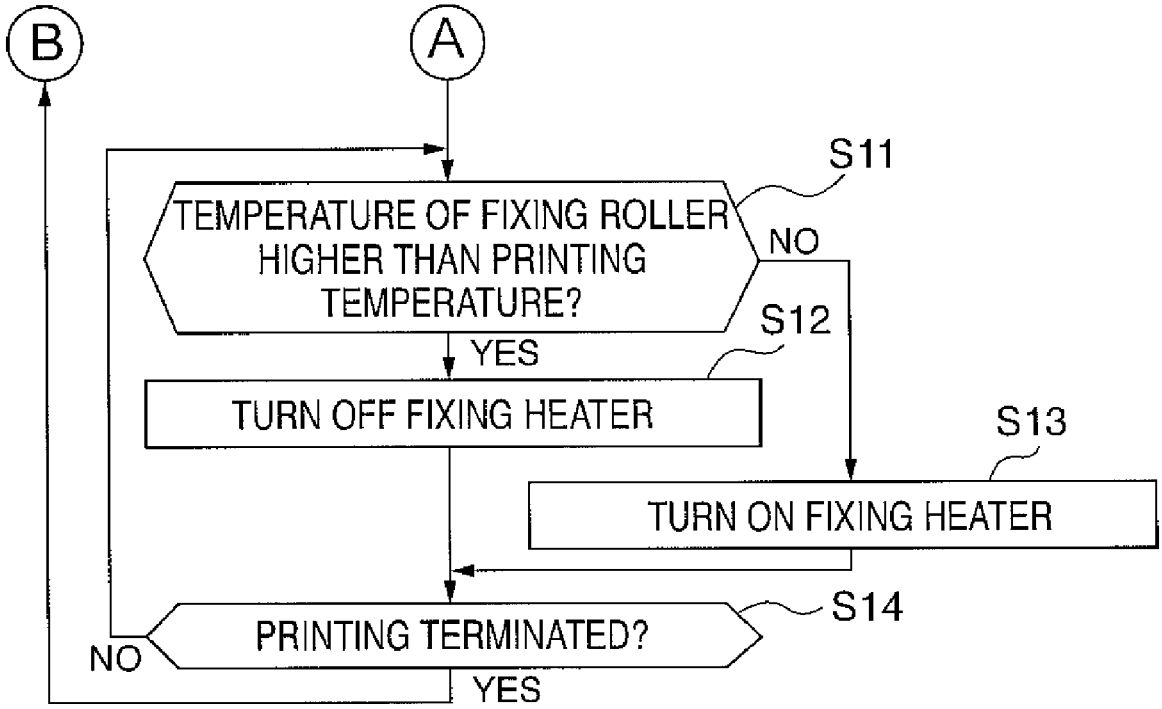

Now, a description will be given of an example of a process for switching between the above-described computing equations for calculating the surface temperature of the fixing roller 1543 from the detection temperature and the compensation temperature, depending on whether the temperature of the fixing roller 1543 rises or drops, with reference to FIG. 9. It should be noted that the process shown in FIG. 9 is executed by the CPU 151*a* after a program stored e.g. in the ROM 151*b* of the system controller 151 is loaded into the RAM 151*c*.

First, in a step S21, a computing equation (the aforementioned equation (1)) for use in the rise of the temperature of the fixing roller 1543 is set. When the power is turned on, the temperature of the fixing roller 1543 is always increased, this setting is first performed. Next, in a step S22, the type of sheets (sheet type) is detected. Here, a sheet type input by the user via the operating section 152 may be detected, the sheet type may be detected e.g. by a sensor.

Next in a step S23, a target temperature of the fixing roller 1543 is set according to the sheet type detected in the step S22.

In the step S23, e.g. when the sheets are of thick paper, a large amount of thermal energy is required for fixing a toner image, so that to fix a toner image on thick paper at the same speed as on thin paper, the target temperature is set to a temperature higher than when the toner image is fixed on the thin paper. On the other hand, e.g. when the sheets are of thin paper, a smaller amount of thermal energy is enough for the fixation, and hence to fix a toner image at the same speed as on thick paper, the target temperature is set to a temperature lower than when the toner image is fixed on the thick paper.

Then, in a step S24, it is determined whether or not the target temperature set in the step S23 is higher than the current surface temperature of the fixing roller 1543.

In the step S24, the computing equation for use in the rise of the temperature of the fixing roller 1543 is set, and therefore if the target temperature is higher than the current surface temperature of the fixing roller 1543, the temperature of the fixing roller 1543 is controlled using the computing equation for use in the rise of the temperature such that the surface temperature of the fixing roller 1543 becomes equal to the target temperature, followed by the process proceeding to a step S26.

On the other hand, if it is determined in the step S24 that the target temperature is not higher than the current surface temperature of the fixing roller 1543, the process proceeds to a step S25. In the step S25, the computing equation for use in the rise of the temperature is switched to a computing equation (the aforementioned equation (2)) for use in the drop of the temperature, and the temperature of the fixing roller 1543 is controlled using the computing equation for use in the drop of the temperature such that the surface temperature of the fixing roller 1543 becomes equal to the target temperature, followed by the process proceeding to the step S26.

In the step S26, it is determined whether or not the surface temperature of the fixing roller 1543 has reached the target temperature. If the surface temperature has not reached the target temperature, the temperature control of the fixing roller 1543 is continued, whereas if it has reached the target temperature, the present process is terminated. It should be noted that after termination of the step S26, the status of the apparatus may be set to standby, or a trigger signal may be delivered to cause the image forming apparatus to start a sheet feeding operation.

As described hereinabove, in the present embodiment, the surface temperature of the fixing roller is calculated using the computing equations based on information from the detection sensor not in contact with the surface of the fixing roller and the compensation sensor, for controlling the temperature of the fixing roller. Further, the surface temperature of the fixing roller is calculated using computing equations which are different depending on whether the target temperature is higher or lower. This makes it possible to accurately detect and control the surface temperature of the fixing roller by a simple circuit configuration without causing a scratch on the surface of the fixing roller.

It should be noted that the present invention is not limited to the above-described embodiment, but it can be practiced in various forms, without departing from the spirit and scope thereof.

It is to be understood that the present invention may also be accomplished by supplying a system or an apparatus with a storage medium in which a program code of software, which realizes the functions of the above described embodiment, is stored, and causing a computer (or CPU or MPU) of the system or apparatus to read out and execute the program code stored in the storage medium.

In this case, the program code itself read from the storage medium realizes the functions of the above described embodiment, and therefore the program code and the storage medium in which the program code is stored constitute the present invention.

Examples of the storage medium for supplying the program code include a floppy (registered trademark) disk, a hard disk, a magnetic-optical disk, an optical disk, such as a CD-ROM, a CD-R, a CD-RW, a DVD-ROM, a DVD-RAM, a DVD-RW, or a DVD+RW, a magnetic tape, a nonvolatile memory card, and a ROM. Alternatively, the program may be downloaded via a network.

Further, it is to be understood that the functions of the above described embodiment may be accomplished not only by executing the program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or a memory provided in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2007-201949 filed Aug. 2, 2007, which is hereby incorporated by reference herein in its entirety.

What is claimed is:

1. An image forming apparatus comprising:

a heating-type fixing device;

a first sensor disposed in a state not in contact with said fixing device, for detecting a temperature of said fixing device;

a second sensor for detecting an ambient temperature of said first sensor; and a controller for controlling a surface temperature of said fixing device, such that the surface temperature of said fixing device becomes equal to a target temperature based on outputs from said first sensor and from said second sensor, wherein said controller, based on whether the target temperature is higher or lower than a current surface temperature of said fixing device, differentiates methods for computing a subsequent surface temperature of said fixing device as part of the controlling of the surface temperature to become equal to the target temperature, wherein when the target temperature is higher than the current surface temperature of said fixing device, said controller computes the subsequent surface temperature of said fixing device in accordance with a difference between maximum output from said second sensor when said fixing device stabilizes at the target temperature and an initial output from said second sensor measured when the temperature control of said controller is started.

2. An image forming apparatus comprising:

a heating-type fixing device;

a first sensor disposed in a state not in contact with said fixing device, for detecting a temperature of said fixing device;

a second sensor for detecting an ambient temperature of said first sensor; and a controller for controlling a surface temperature of said fixing device, such that the surface temperature of said fixing device becomes equal to a target temperature based on outputs from said first sensor and from said second sensor, wherein said controller, based on whether the target temperature is higher or lower than a current surface temperature of said fixing device, differentiates methods for computing a subsequent surface temperature of said fixing device as part of the controlling of the surface temperature to become equal to the target temperature, wherein when the target temperature is lower than the current surface temperature of said fixing device, said controller computes the subsequent surface temperature of said fixing device in accordance with a difference between minimum output from said second sensor when said fixing device stabilizes at the target temperature and an initial output from said second sensor measured when the temperature control of said controller is started.

3. An image forming apparatus as claimed in claim 1, wherein said controller computes the subsequent surface temperature of said fixing device in accordance with a number of sheets, each of which is fixed with a toner image by said fixing device.

4. An image forming apparatus as claimed in claim 2, wherein said controller computes the subsequent surface temperature of said fixing device in accordance with a number of sheets, each of which is fixed with a toner image by said fixing device.

* * * * *